US011473345B2

(12) United States Patent
Williams et al.

(10) Patent No.: US 11,473,345 B2
(45) Date of Patent: Oct. 18, 2022

(54) VEHICLE HOOD LOCKING MECHANISM

(71) Applicant: Toyota Motor Engineering & Manufacturing North America, Inc., Plano, TX (US)

(72) Inventors: Paxton S. Williams, Milan, MI (US); Scott Louis Frederick, Brighton, MI (US); James D. Cunningham, Clarkston, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 169 days.

(21) Appl. No.: 16/700,483

(22) Filed: Dec. 2, 2019

(65) Prior Publication Data

US 2021/0164271 A1 Jun. 3, 2021

(51) Int. Cl.

| | |
|---|---|
| ***E05B 83/24*** | (2014.01) |
| ***E05C 5/00*** | (2006.01) |
| ***E05C 3/00*** | (2006.01) |

(52) U.S. Cl.

CPC ..... *E05B 83/24* (2013.01); *E05C 3/004* (2013.01); *E05C 5/00* (2013.01)

(58) Field of Classification Search

CPC . E05B 83/24; E05C 3/004; E05C 5/00; Y10T 403/7005; Y10T 403/7007

USPC ... 292/194, 198, 216, 219, 220, 338, 57, 58, 292/DIG. 14

See application file for complete search history.

(56) References Cited

U.S. PATENT DOCUMENTS

| | | | | |
|---|---|---|---|---|
| 2,144,126 A * | 1/1939 | Schallis | ..... | E05C 17/085 217/60 F |
| 3,480,247 A | 11/1969 | Waner | | |
| 5,238,213 A | 8/1993 | Pool | | |
| 6,244,650 B1 * | 6/2001 | Namvari | ..... | E05C 17/14 296/76 |
| 8,696,229 B2 * | 4/2014 | Tran | ..... | F16B 7/1463 403/109.4 |

FOREIGN PATENT DOCUMENTS

| | | | | |
|---|---|---|---|---|
| DE | 19954411 A1 * | 2/2001 | ..... | E05B 83/24 |

* cited by examiner

*Primary Examiner* — Christine M Mills
*Assistant Examiner* — Yahya Sidky
(74) *Attorney, Agent, or Firm* — Christopher G. Darrow; Darrow Mustafa PC

(57) ABSTRACT

A vehicle hood locking mechanism includes a housing and a hood lock having a locking portion positioned exterior of the housing. The hood lock is coupled to the housing such that the locking portion is rotatable with respect to the housing between a first rotational position and a second rotational position different from the first rotational position. Rotation of the locking portion to the first rotational position enables insertion of the locking portion through a shaped opening formed in the hood. Rotation of the locking portion to the second rotational position after insertion of the locking portion through the opening prevents withdrawal of the locking portion through the opening until the locking portion is rotated back to the first rotational position. This prevents the hood lock from being inadvertently detached from the raised hood, thereby maintaining the hood in the raised condition.

8 Claims, 3 Drawing Sheets

VEHICLE HOOD LOCKING MECHANISM

TECHNICAL FIELD

The present invention relates to mechanisms for holding a vehicle hood in an open condition and, more particularly, to a vehicle hood locking mechanism engageable to maintain a vehicle hood in a raised condition until positively disengaged by a user to enable lowering of the hood.

BACKGROUND

Devices for supporting a vehicle hood in a raised condition are known. However, many such devices may be inadvertently disengaged by vibration or movements of a user while working under the hood. Disengagement of the device may permit the hood to fall toward a closed condition, possibly injuring the user.

SUMMARY

In one aspect of the embodiments described herein, vehicle hood locking mechanism is provided. The mechanism includes a housing and a hood lock having a locking portion positioned exterior of the housing. The hood lock is coupled to the housing so as to be rotatable with respect to the housing between a first rotational position and a second rotational position different from the first rotational position.

BRIEF DESCRIPTION OF THE DRAWINGS

The accompanying drawings, which are incorporated in and constitute a part of this specification, illustrate embodiments described herein and together with the description serve to explain principles of embodiments described herein.

DETAILED DESCRIPTION

Figure 1:
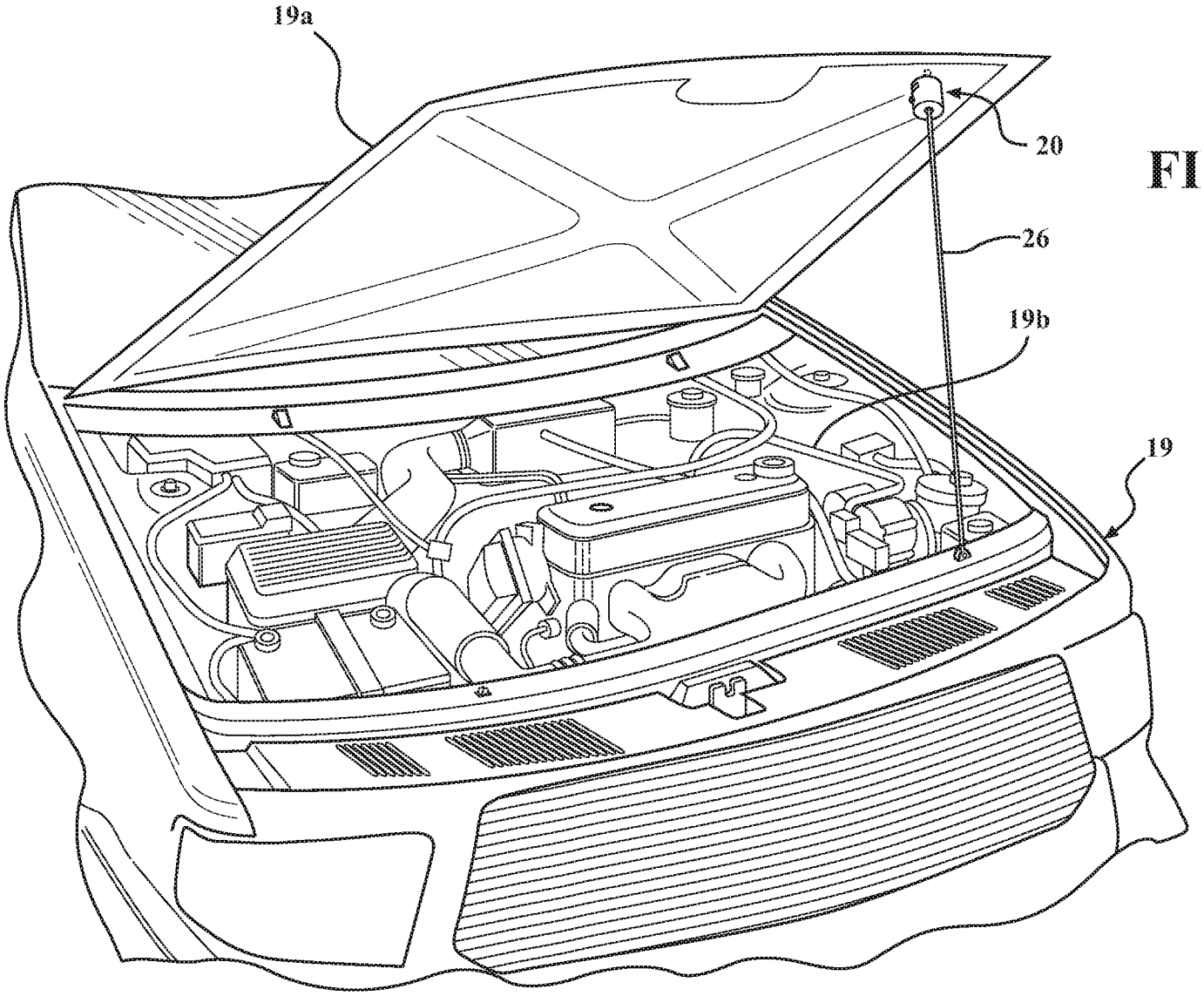
FIG. 1 is a schematic perspective view of a vehicle hood locking mechanism in accordance with an embodiment described herein, shown in a locked condition to support a raised vehicle hood.

Embodiments described herein relate to a vehicle hood locking mechanism including a housing and a hood lock having a locking portion positioned exterior of the housing. The hood lock is coupled to the housing such that the locking portion is rotatable with respect to the housing between a first rotational position and a second rotational position different from the first rotational position. Rotation of the locking portion to the first rotational position enables insertion of the locking portion through a shaped opening formed in the hood. Rotation of the locking portion to the second rotational position after insertion of the locking portion through the opening prevents withdrawal of the locking portion through the opening until the locking portion is rotated back to the first rotational position. This prevents the hood lock from being inadvertently detached from the raised hood, thereby maintaining the hood in the raised condition.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. Unless otherwise noted, similar reference characters are used to describe similar features on separate elements and/or embodiments. Any of the components described herein may be formed from a material (or materials) suitable for the purpose(s) of the element as described herein.

FIGS. 1-3B illustrate the structure and operation of a vehicle hood locking mechanism (generally designated 20) in accordance with an embodiment described herein. The hood locking mechanism 20 may be operable to hold a vehicle hood 19*a* in a raised position as shown in FIG. 1 while a user accesses the vehicle engine compartment 19*b*. In one or more arrangements, the hood locking mechanism 20 may be mounted on (or may include) a rotatable stalk attached to the vehicle 19 under the vehicle hood 19*a*.

Figure 2B:
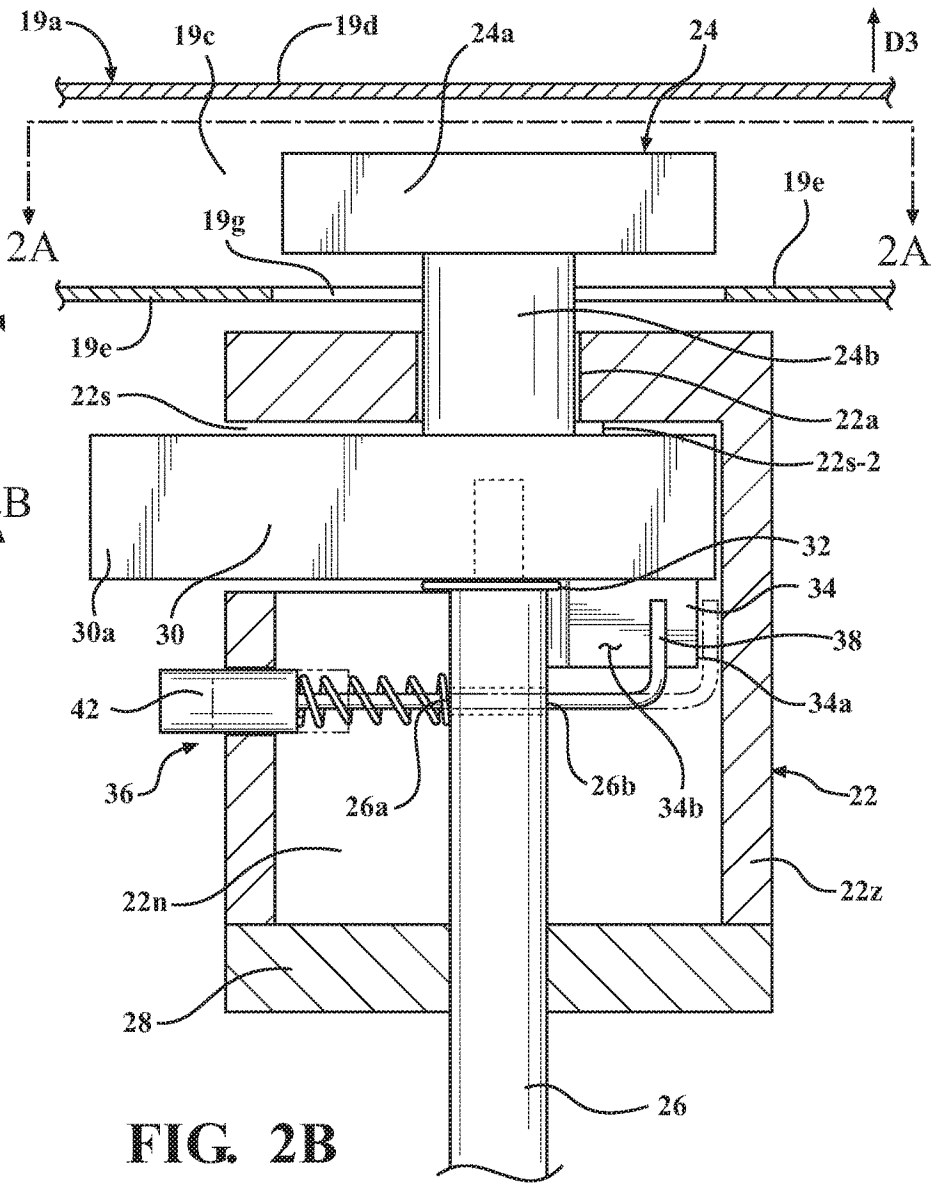
FIG. 2B is a schematic side cross-sectional view of the vehicle hood locking mechanism in the configuration shown in FIG. 2A.

In one or more arrangements, the hood locking mechanism 20 may include a housing 22 having an interior 22*n*, and a hood lock 24 having a locking portion 24*a* positioned exterior of the housing 22. The locking portion 24*a* may also be spaced apart from the housing 22, as shown in FIG. 2B. The locking portion 24*a* may be coupled to the housing 22 so as to be rotatable with respect to the housing 22 between a first rotational position (shown as a solid line in FIG. 2A) and a second rotational position (shown as a solid line in FIG. 3A), which is different from the first rotational position.

The hood lock locking portion 24*a* may be connected to an element in an interior of the housing 22 through a connecting portion 24*b* extending through an opening 22*a* formed in the housing. The hood lock locking portion 24*a* may be structured to be received in a cavity 19*c* formed between an exterior panel 19*d* of the hood 19*a* (i.e., a panel facing outwardly away from the vehicle 19) and an interior panel 19*e* of the hood 19*a* (a panel facing, for example, in a direction toward the engine compartment 19*b* of the vehicle 19). The hood lock locking portion 24*a* may be shaped to be extendible into the cavity 19*c* through an associated opening 19*g* formed in the hood interior panel 19*e* when the hood locking portion 24*a* resides in the first rotational position. After positioning of the hood locking portion 24*a* in the cavity 19*c*, the hood locking portion 24*a* may be prevented from being withdrawn out of the cavity 19*c* through the opening 19*g* by rotation of the hood locking portion 24*a* from the first rotational position to the second rotational position. By this arrangement, the hood locking portion 24*a* is prevented from disengaging from the raised hood 19*a* until positively rotated by a user to enable withdrawal of the hood locking portion 24*a* from the cavity 19*c* through the opening 19*g*.

The housing 22 and other elements of the hood locking mechanism 20 may be statically or rotatably mounted to a mounting member 26 using any suitable method. In one example, a housing support base 28 may be secured to the mounting member 26 and the housing 22 may be attached to the support base 28 to secure the housing to the mounting member. In one or more arrangements, and as shown in the drawings, the mounting member 26 may be the rotatable stalk. In other arrangements, the mounting member 26 may be a member separate from the stalk and which is structured to be attachable to the stalk.

In one or more arrangements, an actuator 30 may be coupled to the mounting member 26 so as to be rotatable with respect to the mounting member 26. The hood lock locking portion 24*a* may be coupled to the actuator 30 so that the locking portion 24*a* and the actuator 30 rotate together during operation of the hood locking mechanism 20. The actuator 30 may be operable to rotate the hood lock locking portion 24*a* from the second rotational position to the first rotational position. For this purpose, the actuator 30 may include a portion 30*a* residing exterior of the housing 22. The housing 22 may include a slot 22*s* extending through a wall 22*z* thereof. The actuator 30 may extend from an interior 22*n* of the housing through the slot 22*s* to the exterior of the housing 22. The actuator 30 may be structured to be rotatable between a first end 22*s*-1 of the slot 22*s* and a second end 22*s*-1 of the slot.

An actuator spring member 32 may be coupled to the actuator 30 and structured to exert a force on the actuator 30 urging rotation of the actuator in a first rotational direction R1. For example, the actuator spring member 32 may be a torsion spring structured to operate in the manner described herein, with a first end (not shown) attached to the mounting member 26 and a second end 32*a* attached to the actuator 30.

A cam 34 may be coupled to the actuator 30 so that the cam 34 and the actuator 30 rotate together. Thus, the actuator 30, hood lock locking portion 24*a*, and cam 34 may rotate together at a common angular rate during operation of the hood locking mechanism 20. In addition, a first rotational position of the cam 34 may be associated with the first rotational position of the locking portion 24*a*, and a first rotational position of the actuator 30 may also be associated with the first rotational position of the locking portion 24*a*.

Figure 2A:
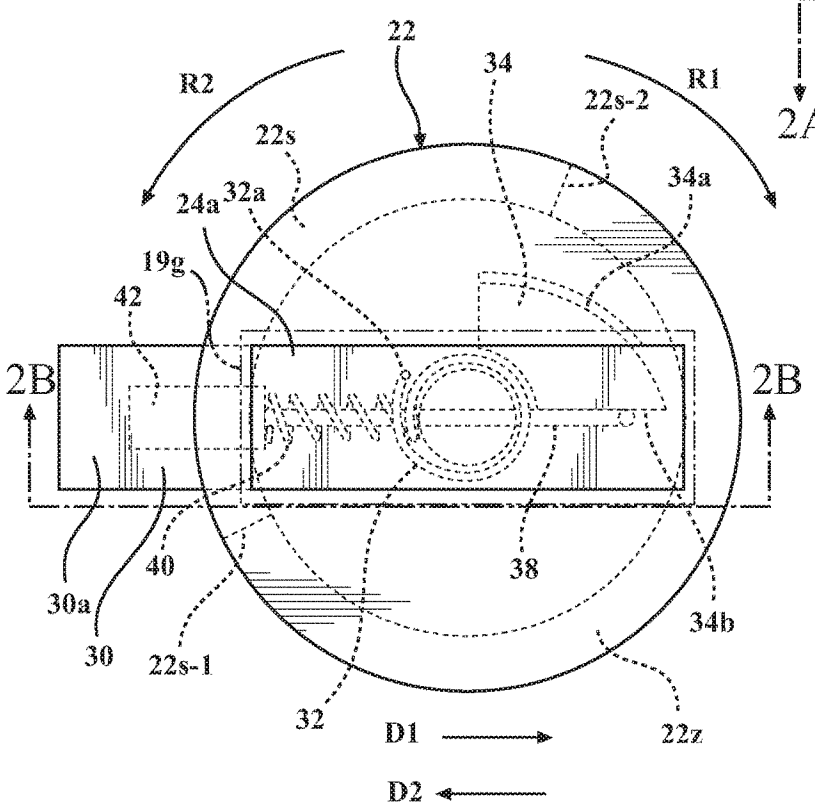
FIG. 2A is a schematic plan view of the vehicle hood locking mechanism of FIG. 1, showing a locking portion of the mechanism oriented in a first rotational position for insertion into an opening formed in a vehicle hood.
Figure 3B:
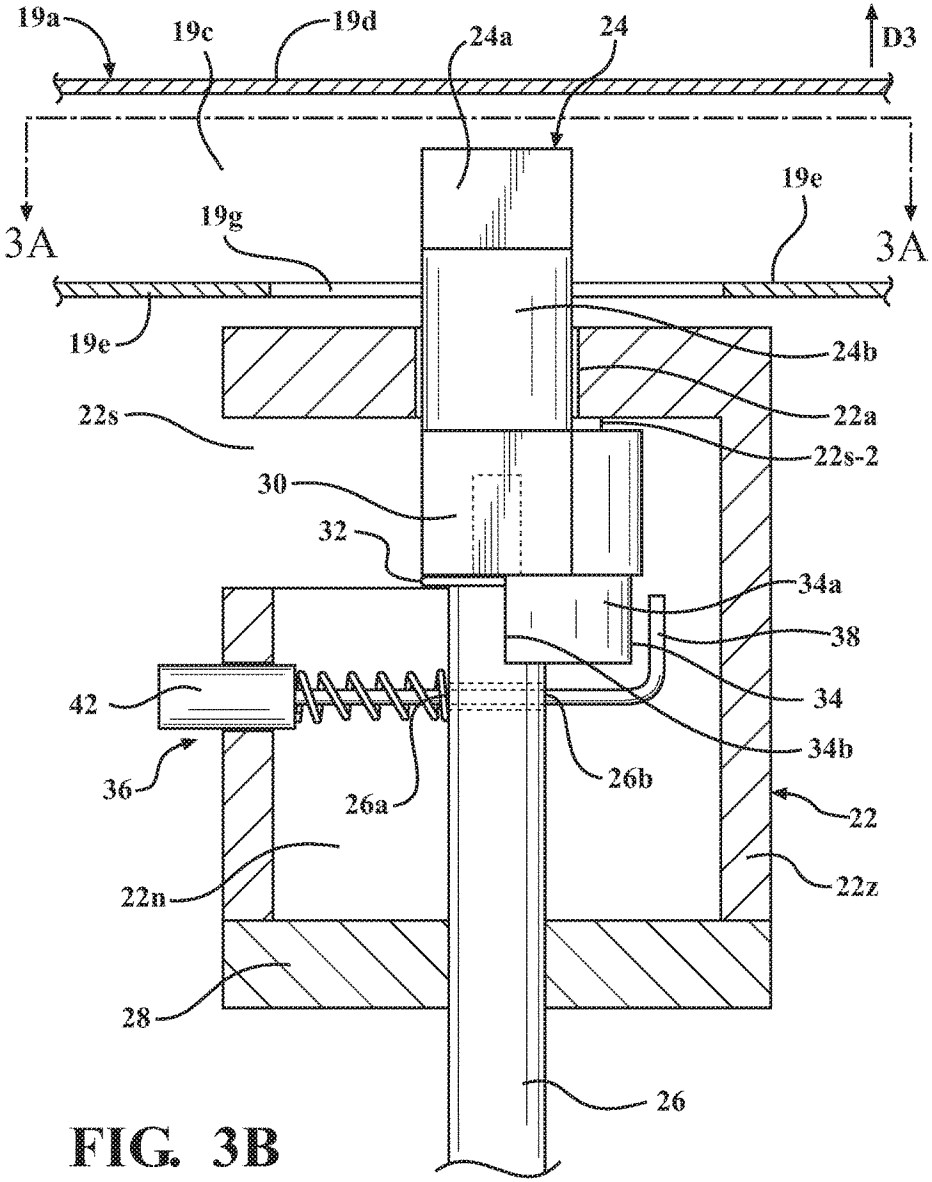
FIG. 3B is a schematic side cross-sectional view of the vehicle hood locking mechanism in the configuration shown in FIG. 3A.
Figure 3A:
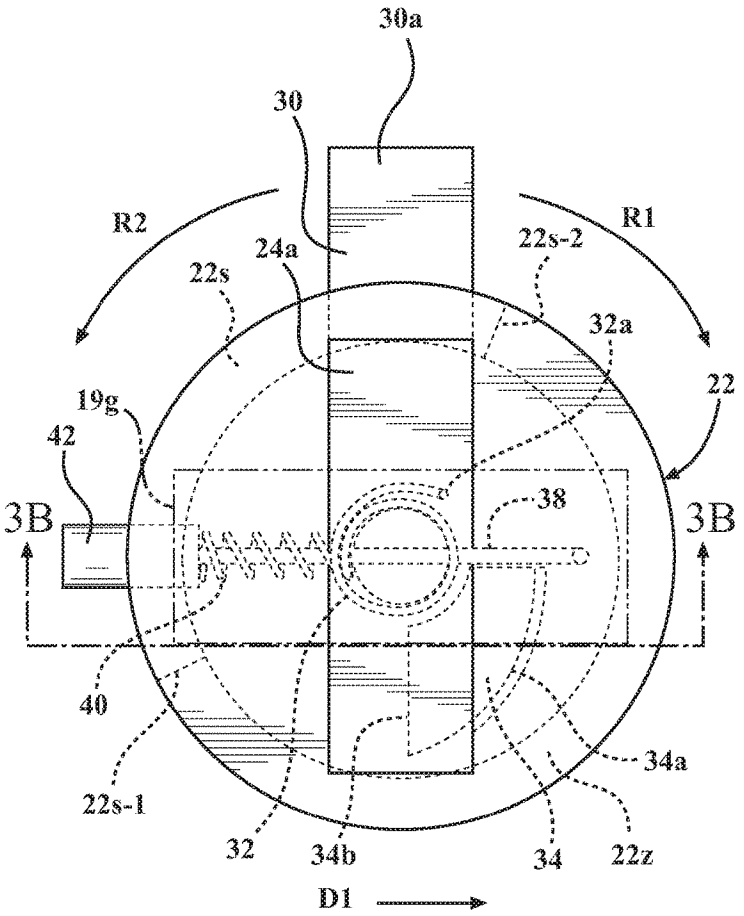
FIG. 3A is a schematic plan view of the vehicle hood locking mechanism of FIG. 1, showing a locking portion of the mechanism oriented in a second rotational position after insertion through the opening formed in a vehicle hood, to prevent withdrawal of the locking portion back through the opening.

Also, a second rotational position of the cam 34 may be associated with the second rotational position of the locking portion 24*a*, and a second rotational position of the actuator 30 may also be associated with the second rotational position of the locking portion 24*a* (i.e., each of the cam 34 and the actuator 30 has a first rotational position corresponding to the first rotational position of the locking portion 24*a*, and each of the cam 34 and the actuator 30 has a second rotational position corresponding to the second rotational position of the locking portion 24*a*). The first rotational positions of the locking portion 24*a*/cam 34/actuator 30 are shown in FIGS. 2A-2B, and the second rotational positions of the locking portion 24*a*/cam 34/actuator 30 are shown in FIGS. 3A-3B. Thus, the rotational positions of the locking portion 24*a*/cam 34/actuator 30 shown in FIGS. 2A-2B may be referred to collectively herein as the "first rotational position". In addition, the rotational positions of the locking portion 24*a*/cam 34/actuator 30 shown in FIGS. 3A-3B may be referred to collectively herein as the "second rotational position".

The cam 34, actuator 30, and locking portion 24*a* may be rotatably mounted to the mounting member 26. The cam 34, actuator 30, and locking portion 24*a* may be formed as a single piece from a suitable polymer. Alternatively, the cam 34, actuator 30, and locking portion 24*a* may be formed separately and secured together using any suitable method, such as adhesive application.

The cam 34 may include an actuation surface 34*a* and a stop surface 34*b* intersecting the actuation surface 34*a*. The actuation surface 34*a* may be a camming surface structured to engage a detent 38 (described below) when the actuator 30/cam 34 is rotated in a second rotational direction R2 as described herein, to gradually move the detent in a first detent direction D1 within the housing 22.

A trigger mechanism 36 may be operably coupled to the cam 34. The trigger mechanism 36 may include detent 38 which is structured to contact the cam stop surface 34*b* as shown in FIGS. 2A and 2B to prevent rotation of the cam 34 in the first rotational direction R1 responsive to the force exerted by the actuator spring member 32 on the actuator 30 when the hood lock locking portion 24*a* is in the first rotational position. The detent 38 may also be operable in the first detent direction D1 to separate from the cam 34 so as to enable rotation of the cam 34 from the first rotational position to the second rotational position responsive to the force exerted by the actuator spring member 32 on the actuator 30. The detent 38 may also be structured to be movable as described herein back to the position shown in FIGS. 2A and 2B where the detent prevents rotation of the cam 34 in the first rotational direction R1 responsive to the force exerted by the spring member 32 on the actuator 30, after the detent 38 separates from the actuation surface 34*a* of the cam 34.

In one or more arrangements, a detent spring member 40 may be structured to exert a force urging the detent 38 in a second detent direction D2 opposite the first detent direction D1. In one or more arrangements, the detent spring member 40 may be a conventional coil spring member structured to operate in the manner described herein.

The detent 38 may also be structured to contact the cam 34 to slide along the actuation surface 34*a* of the cam during rotation of the locking portion 24*a*/cam 34/actuator 30 from the second rotational position to the first rotational position, in the manner described herein. The detent 38 may also be structured to separate from the actuation surface 34*a* of the cam 34 responsive to the force exerted by detent spring member 40 when the locking portion 24*a*/cam 34/actuator 30 have been rotated from the second rotational position to the first rotational position. After separation from the actuation surface 34*a*, the detent may move to the position shown in FIGS. 2A-2B, in a position to contact the cam stop surface 34*b* to prevent rotation of the cam 34 in the first rotational direction R1.

In particular embodiments and as shown in the drawings, the detent 38 may extend from a first side 26*a* of the mounting member 26 through the mounting member through a hole in the mounting member to a second side 26*b* of the mounting member opposite the first side 26*a* of the mounting member 26. In such embodiments, the detent 38 may be structured to contact the cam 34 along the second side 26*b* of the mounting member 26.

A button 42 may extend to the exterior of the housing 22 through an opening 22*a* formed in the housing wall 22*z*. The button 42 may be coupled to the detent 38 so that the button 42 and the detent 38 move together. The detent 38 may be movable to separate from the cam 34 (as shown in phantom in FIG. 2B) by moving the button 42 in the first detent direction D1. The detent spring member 40 may spring load the button 42 and detent 38 so as to urge the button 42 and detent 38 in the second detent direction D2.

The locking portion 24*a* may be rotatable to any of the first and second rotational positions with respect to the static housing 22 (i.e., while the housing 22 is held in a fixed, non-rotatable position). In one or more arrangements, the first rotational position of the locking portion 24*a*/cam 34/actuator 30 may correspond to positions of the locking portion 24*a*/cam 34/actuator 30 when the actuator 30 is rotated to a first end 22*s*-1 of housing slot 22*s*, as described herein and shown in FIGS. 2A-2B. The second rotational position of the locking portion 24*a*/cam 34/actuator 30 may correspond to positions of the locking portion 24*a*/cam 34/actuator 30 when the actuator 30 is rotated to a second end 22*s*-2 of housing slot 22*s*, as described herein and shown in FIGS. 3A-3B.

Operation of the hood locking mechanism embodiment shown is illustrated in FIGS. 1-3B. A free end of stalk 26 having elements of the hood locking mechanism 20 mounted thereon may be rotated upwardly toward the vehicle hood 19*a*. The locking portion 24*a* of the hood locking mechanism 20, rotated to the configuration shown in FIGS. 2A and 2B, may be inserted through the opening 19*g* formed in the interior panel 19*e* in direction D3 (FIG. 2B), into cavity 19*c* formed between the interior panel 19*e* and the exterior panel 19*d*. As seen, in this configuration, the locking portion 24*a* is rotated to the first rotational position and the opening 19*g* is sized to receive the locking portion 24*a* therethrough when the locking portion 24*a* is in the first rotational position. In this configuration, the detent 38 is positioned so as contact the cam stop surface 34*b*, to prevent rotation of the cam 34 in the first rotational direction R1. The detent spring member 40 biases the button 42 and detent 38 in the second detent direction D2.

After the locking portion 24*a* is inserted into the cavity 19*c*, a user may push the button 42 to move the button in the first detent direction D1, also moving the detent 38 in the first detent direction D1 along the cam stop surface 34*b*. The detent 38 may continue to move until detent moves past the stop surface (as shown in phantom in FIG. 2B), thereby releasing the cam 34 for rotation. The locking portion 24*a*/cam 34/actuator 30 may now rotate in the first rotational direction R1 to the second rotational position (FIGS. 3A-3B) responsive to forces exerted by the actuation spring member 32.

The locking portion 24*a*/cam 34/actuator 30 may rotate in direction R1 until the actuator 30 contacts a second end 22*s*-2 of the slot 22*s* formed in the housing 22, at which point the locking portion 24*a* resides in its second rotational position. FIG. 2A shows (as a solid line) the locking portion 24*a* rotated to the second rotational position. As may be seen, in this second rotational position, the locking portion 24*a* may not pass back through the interior panel opening 19*g*. The locking portion 24*a* may remain in the second rotational position responsive to forces exerted by the actuation spring member 32 until the actuator 30 is rotated by a user back to the first rotational position.

To remove the locking portion 24*a* from the cavity 19*c*, a user may rotate actuator 30 along slot 22*s* from the slot second end 22*s*-2 to the slot first end 22*s*-1. During this rotation, cam actuation surface 34*a* contacts detent 38 and detent 38 slides along the actuation surface 34*a*, consequently moving in detent direction D1 until it reaches the stop surface 34*b*. Further rotation of the cam past this point causes the detent 38 to separate from the cam 34, wherein the cam returns to the position in FIGS. 2A-2B responsive to the forces exerted by spring member 40 in second detent direction D2. In the position shown in FIGS. 2A-2B, detent 38 once again contacts stop surface 34*b* to prevent rotation of the cam 34 until the detent is moved as previously described.

In the above detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A vehicle hood locking mechanism comprising:

a housing mounted to a mounting member;

a hood lock having a locking portion positioned exterior of the housing, the locking portion being coupled to the housing so as to be rotatable with respect to the housing between a first rotational position and a second rotational position different from the first rotational position;

an actuator coupled to the locking portion so that the locking portion and the actuator are structured to always rotate together, the actuator being coupled to the mounting member so as to be rotatable with respect to the mounting member, the actuator having a portion residing exterior of the housing, wherein rotation of the actuator operates to rotate the locking portion from the second rotational position to the first rotational position;

a cam coupled to the actuator so that the cam and the actuator rotate together;

an actuator spring member coupled to the actuator and structured to exert a force on the actuator urging rotation of the actuator in a first rotational direction, wherein the locking portion is coupled to the actuator so that the locking portion and the actuator rotate together; and a detent operably coupled to the cam and structured to contact the cam to prevent rotation of the cam in the first rotational direction responsive to the force exerted by the actuator spring member on the actuator when the locking portion is in the first rotational position, the detent being operable in a first detent direction to separate from the cam so as to enable rotation of the cam from the first rotational position to the second rotational position responsive to the force exerted by the actuator spring member on the actuator.

2. The hood locking mechanism of claim 1 wherein the detent extends from a first side of the mounting member through the mounting member to a second side of the mounting member opposite the first side of the mounting member, and wherein the detent is structured to contact the cam along the second side of the mounting member.

3. The hood locking mechanism of claim 1 wherein the detent is structured to contact the cam to slide along an actuation surface of the cam during rotation of the locking portion from the second rotational position to the first rotational position.

4. The hood locking mechanism of claim 3 further comprising a detent spring member structured to exert a force urging the detent in a second detent direction opposite the first detent direction.

5. The hood locking mechanism of claim 4 wherein the detent is structured to separate from the actuation surface of the cam responsive to the force exerted by detent spring member when the locking portion has been rotated from the second rotational position to the first rotational position, and wherein the detent is structured to move to a position where the detent prevents rotation of the cam in the first rotational direction responsive to the force exerted by the detent spring member on the actuator, after the detent separates from the actuation surface of the cam.

6. The hood locking mechanism of claim 1 further comprising a button extending to the exterior of the housing and coupled to the detent so that the button and the detent move together, and wherein the detent is movable to separate from the cam by movement of the button in the first detent direction.

7. The hood locking mechanism of claim 1 wherein the housing includes a slot formed therealong, wherein the actuator extends from an interior of the housing through the slot to the exterior of the housing, and wherein the actuator is structured to be rotatable between a first end of the slot and a second end of the slot.

8. A vehicle including a vehicle hood locking mechanism in accordance with claim 1.

* * * * *